US005940103A

United States Patent [19]

Hetzer et al.

[11] Patent Number: 5,940,103

[45] Date of Patent: Aug. 17, 1999

[54] DEVICE FOR PREVENTING RE-USE OF A CONTAINER FOR SUPPLYING INK

[75] Inventors: Ulrich Hetzer; Michael Seikel, both of Berlin, Germany

[73] Assignee: Francotyp-Postalia AG & Co., Birkenwerder, Germany

[21] Appl. No.: 08/838,410

[22] Filed: Apr. 7, 1997

[30] Foreign Application Priority Data

Apr. 6, 1996 [DE] Germany ..... 196 13 945

[51] Int. Cl.[6] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 5,283,593 | 2/1994 | Wehl | 347/86 |
| 5,365,312 | 11/1994 | Hillmann | 355/206 |

FOREIGN PATENT DOCUMENTS

| | | |
|---|---|---|
| 0 610 965 A1 | 8/1994 | European Pat. Off. . |
| 8-20114 | 1/1996 | Japan . |
| 2 133 502 | 7/1984 | United Kingdom . |
| 90/00976 | 2/1990 | WIPO . |
| WO 90/00971 | 2/1990 | WIPO . |

*Primary Examiner*—N. Le
*Assistant Examiner*—Anh T. N. Vo
*Attorney, Agent, or Firm*—Herbert L. Lerner; Laurence A. Greenberg

[57] ABSTRACT

An ink connecting line from an ink printing head is docked on a container with a hollow needle passing through a rubber-elastic closure. A device for preventing re-use of the container for supplying ink to the ink printing head has high functional security, only allows the use of new fresh ink containers prescribed by the printer manufacturer and suppresses the use of fresh ink containers that have already been in operation and were then refilled. A hermetically closing cover device is provided inside the container for an insertion region of the hollow needle and can be tripped irreversibly through the use of the hollow needle the first time it is inserted. Once the hollow needle has been pulled out, ink can no longer flow out even if the needle is reinserted.

4 Claims, 3 Drawing Sheets

DEVICE FOR PREVENTING RE-USE OF A CONTAINER FOR SUPPLYING INK

BACKGROUND OF THE INVENTION

Field of the Invention

The invention relates to a device for preventing re-use of a container for supplying ink to an ink printing head.

Such ink printing heads are used both in typical office printers and in small high-speed printers. The latter are components of modern machines for printing addresses or for product labeling and will soon also be part of machines for applying postage to mail.

The function of the printing heads should be assured in such a way that if at all possible no missing ink dots will occur. That is important not only for the sake of the printed image quality in general but also and in particular for security-relevant printed image data, such as the monetary value, the date and the serial number of the machine in the case of postage printing. If missing ink dots and damage to the printing head are to be prevented, among other requirements the supply of the proper ink for the ink printing head must be absolutely assured to be as free of bubbles as possible.

It is usual (see German Patent DE 27 09 730 C2) for the ink connecting line from the ink printing head to the container for the ink supply, which is referred to below as the fresh ink container, to be docked on the ink container through a hollow needle. The ink container is provided with a rubber-elastic closure that is pierced by the hollow needle. That prevents both the invasion of air into the ink connecting line and an unintended escape of ink from the ink container. With that docking principle, however, it is possible that partly or entirely emptied fresh ink containers may be refilled with any arbitrary ink by unauthorized persons and inserted into the printer. That can cause failure or even damage to the ink printing head.

SUMMARY OF THE INVENTION

It is accordingly an object of the invention to provide a device for preventing re-use of a container for supplying ink, which overcomes the hereinafore-mentioned disadvantages of the heretofore-known devices of this general type and which increases functional security. It is additionally an object of the invention to develop a device for preventing re-use that allows the use of only new fresh ink containers prescribed by the printer manufacturer, while preserving the initially described docking of the fresh ink container and preventing the use of fresh ink containers that have already been in operation and then refilled.

With the foregoing and other objects in view there is provided, in accordance with the invention, in an assembly having an ink printing head, an ink connecting line connected to the ink printing head, a container with a rubber-elastic closure for supplying ink to the ink printing head, and a hollow needle having an insertion region docking the ink connecting line on the container through the closure, a device for preventing re-use of the container, comprising a hermetically sealing cover device inside the container for the insertion region of the hollow needle, the cover device tripping irreversibly upon initial insertion of the hollow needle.

In accordance with another feature of the invention, the container has a front wall with an inside, and the cover device includes an axially resiliently displaceable and lockable tube, a resiliently supported rocker rotationally movable inside the tube, and a brace formed onto the inside of the front wall of the container.

In accordance with a further feature of the invention, the brace has a shaft and a neck; the hollow needle is guided in the shaft; the tube is longitudinally displaceable about the shaft, lockable in two positions and has an opening; the shaft has a stop thereon for the rocker; and the neck is adapted to the opening in the tube and has a rubber-elastic sealing ring.

In accordance with an added feature of the invention, the container has a rear wall and a bottom with ribs formed on the bottom and protrusions formed on the ribs; the tube has a bottom, an outer jacket and resilient detent hooks attached to the outer jacket and resting displaceably on the ribs for locking on the protrusions; the cover device has a compression spring fastened between the tube and the rear wall of the container; the rocker has a shaft and first and second lever arms supported rotationally movably about the shaft; the first lever arm points into the tube and acts as a securing lever having a roller-like end guided in an adapted recess formed in the tube bottom, the first lever arm has a formed-on, partly rounded protrusion, the protrusion has an edge to be locked on the stop of the shaft and the protrusion has a prong-like extension to be placed on the stop; the second lever arm points at the opening of the tube and has a spherical end; and the shaft of the rocker is guided in a longitudinal groove formed in the tube and open toward the opening of the tube.

In accordance with a concomitant feature of the invention, the tube has a given stroke length, the neck of the brace has an extension outside of the front wall of the housing, a funnel with a conical bore in the extension, and a rubber-elastic closure fitted into the conical bore, and the shaft of the brace has a longitudinal slit adapted to the rocker and to the given stroke length.

Since a covering device can be tripped irreversibly through the use of the hollow needle for the ink docking, for a fresh ink container once docked, although it can be reinserted after the hollow needle has been pulled out, nevertheless ink can no longer flow out. This is true regardless of how much ink is still left in the device for preventing re-use.

A fresh ink container that has been undocked once and then redocked can accordingly no longer be used for the ink supply but instead can then be used, if at all, only for ink disposal, as a waste ink container.

Other features which are considered as characteristic for the invention are set forth in the appended claims.

Although the invention is illustrated and described herein as embodied in a device for preventing re-use of a container for supplying ink, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
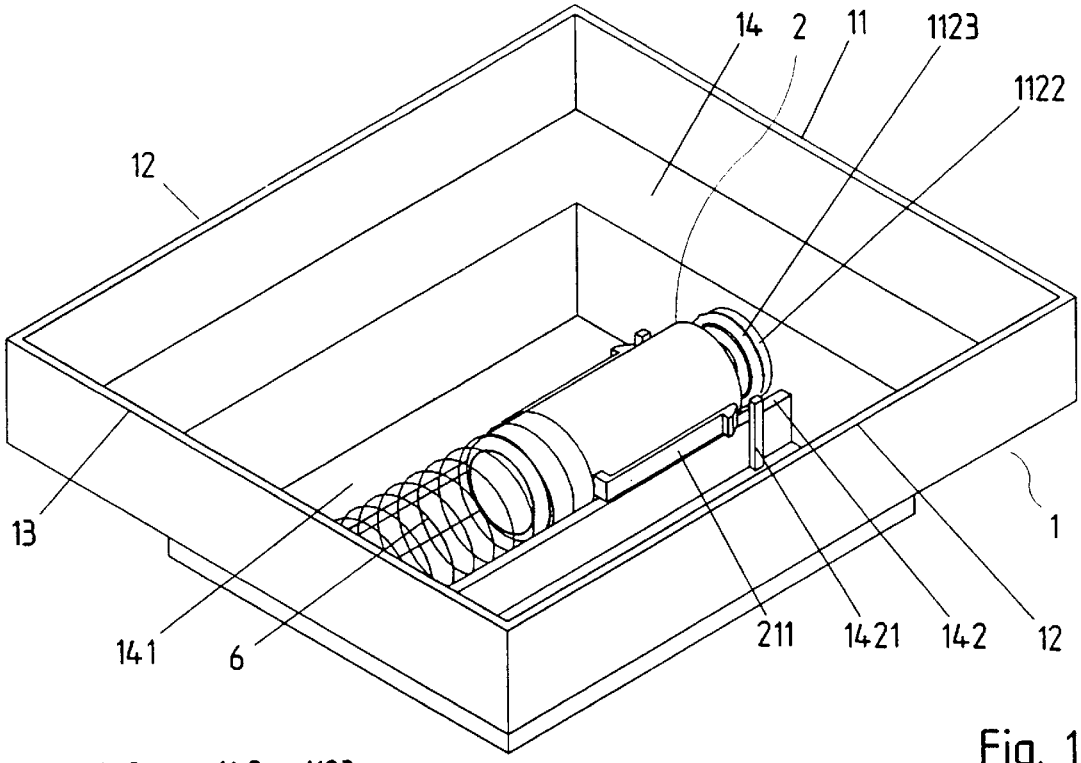
FIG. 1 is a diagrammatic, perspective view of a fresh ink container.
Figure 2:
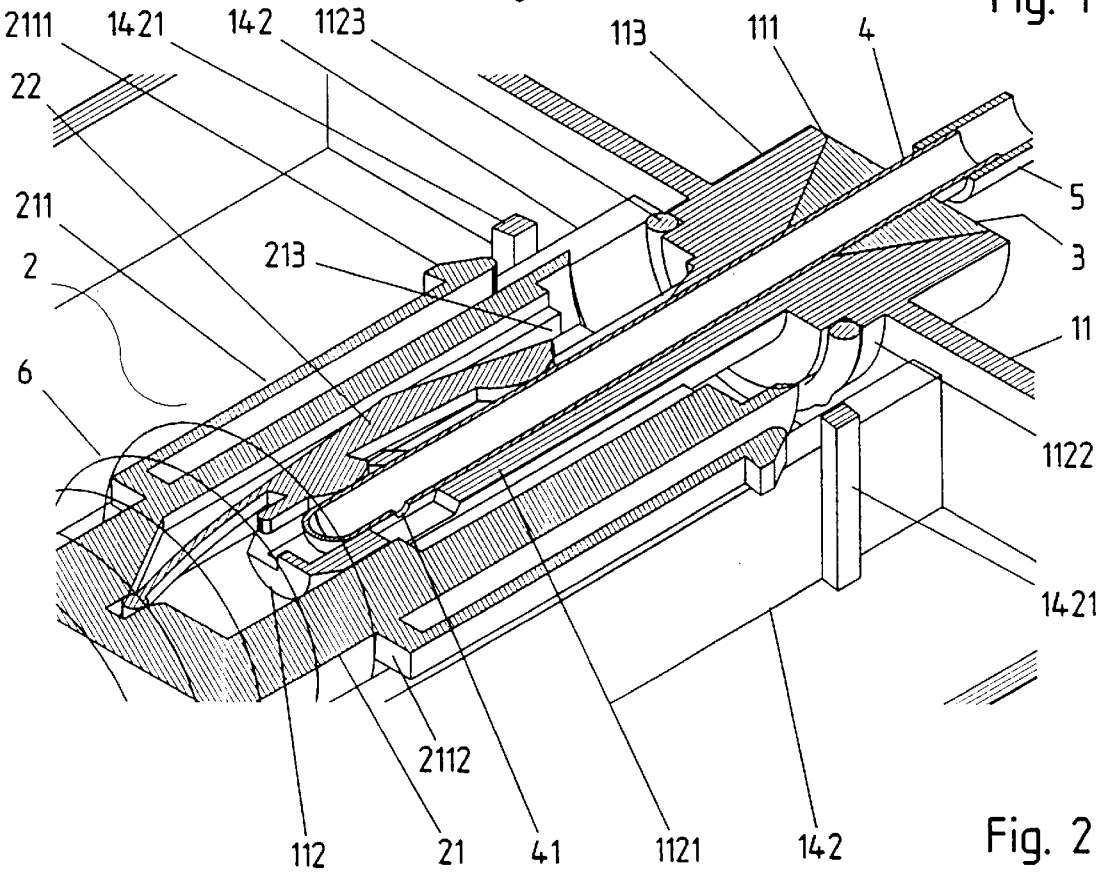
FIG. 2 is an enlarged, fragmentary, sectional view of a covering device of FIG. 1.

Referring now in detail to the figures of the drawings, which are partly diagrammatic for the sake of simplicity and better comprehension, and first, particularly, to FIG. 1 thereof, there is seen a fresh ink container 1 that has a well-like depression 141 in a bottom 14, and a cover device 2 for an insertion region of a hollow needle 4 which is disposed in the depression, as is seen in FIG. 2. The cover device 2 is disposed displaceably on two ribs 142 formed onto the bottom 14 of the depression 141. The ribs 142 are provided with protrusions 1421, on which the cover device 2 can be locked through the use of detent hooks 211. A compression spring 6 is fastened between a back wall 13 of the housing or depressions 141 and a rear portion of the cover device 2. A flange-like neck 1122 with a sealing ring 1123 is disposed opposite a front portion of the cover device 2 in a front wall 11 of the container 1 or of the well-like depression 141.

As is seen in FIG. 2, the cover device 2 includes a tube 21 and a rocker 22 disposed in the tube 21. The jacket of the tube 21 has two detent hooks 211 located parallel to the jacket and secured to the tube 21 at a shoulder 2112. The shoulder 2112 also serves as a stop for the compression spring 6. An end or tip 2111 of each detent hook is thickened in wedge-like fashion or barbed and offset. As a result, the detent hooks 211 on one hand can slide past the protrusions 1421 in the direction of the front wall 11, but on the other hand, after moving past the protrusions 1421, they can catch firmly behind them and thus lock the tube 21.

The tube 21 surrounds a brace 112 that is formed onto the inside of the front wall 11 of the housing 1. The brace 112 has the neck 1122, which is disposed directly at the front wall 11, is adapted to the opening in the tube 21 and on which the rubber-elastic sealing ring 1123 is seated. If the tube 21 is displaced toward the front wall 11, then the tube opening is sealed off by the neck 1122 and the sealing ring. A funnel 113 is provided on the outside of the front wall 11, as an extension of the brace 112. The funnel 113 has a conical bore 111, which is continued in the form of a straight bore in the brace 112. A rubber-elastic closure 3 which is fitted into the bore 111, is pierced by the inserted hollow needle 4. The hollow needle 4 has a front end with an ink opening 41, through which ink passes out of the container 1 into the hollow needle 4 and onward into an ink connecting line 5 to reach an ink printing head. The conical bore 111 in the funnel 113 assures that the hollow needle 4 will necessarily reach the brace 112.

FIGS. 3*a*–3*d* show the interplay between the hollow needle 4 and the cover device 2 and especially the operative connection between the hollow needle 4 and the rocker 22.

Figure 3A:
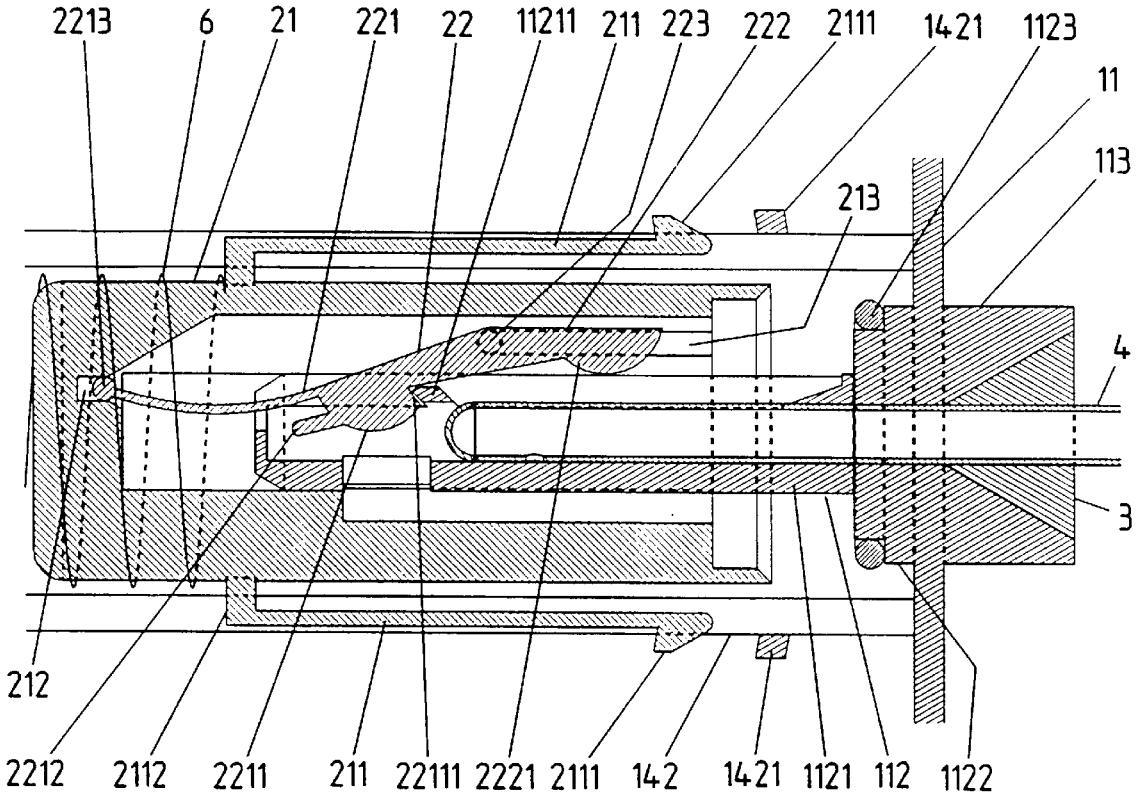
FIG. 3*a* is a longitudinal-sectional view of the cover device with a hollow needle inserted before reaching a securing lever.

In FIG. 3*a*, the rocker 22 is constructed as a two-armed lever. The rocker 22 has a first lever arm 221 with a roller-like end 2213 and a middle portion with a spherically shaped protrusion 2211. The protrusion 2211 has one end which ends in a prong-like extension 2212 and another end that ends abruptly at an edge 22111. The first lever arm 221 serves the function of a securing lever. A second lever arm 222 of the rocker 22 has a spherically constructed end 2221. The rocker 22 has a shaft 223 which is supported in a longitudinal groove 213 in the tube 21. The groove is open toward the opening of the tube. The tube 21 has a bottom provided with a recess 212 for receiving the roller-like end 2213 of the first lever arm 221.

It can be appreciated that installing the rocker 22 in the tube 21 is simple. The rocker 22 is inserted with its shaft 223 into the longitudinal groove 213 and allowed to drop inward until the end 2213 rests in the adapted recess 212. Mounting the cover device 2 is analogously simple. The tube 21 is thrust onto the brace 112 far enough to ensure that the edge 22111 of the protrusion 2211 meets a stop 11211 and hooks firmly thereon. The stop 11211 is disposed as a crossbar in a longitudinal slot 11212 of the brace 112, shown in FIG. 3*c*. The rocker 22 plunges partway into the longitudinal slot 11212. One end of the compression spring 6 is thrust onto the end of the tube 21 until it meets the shoulders 2112 of the detent hooks 211 and on the other end it is locked in a non-illustrated manner on the rear wall 13 of the container 1. The transmission of force from the compression spring 6 to the brace 112 is effected through the shoulders 2112 onto the tube body 21, from there through the end of the longitudinal groove 213 to the shaft 223, from there through the first lever arm 221 to the edge 22111 of the protrusion 2211, and finally from the edge 22111 to the stop 11211 on the shaft 1121 of the brace 112.

In this first locking position of the cover device 2, the tube 21 surrounds the brace 112 in spaced-apart fashion with respect to the neck 1122 thereof, so that ink flows out of the container 1 through the tube opening into the tube 21 and from it through the longitudinal slit 11212 and a further opposite ink inlet opening 11213 into the brace 112.

Figure 3B:
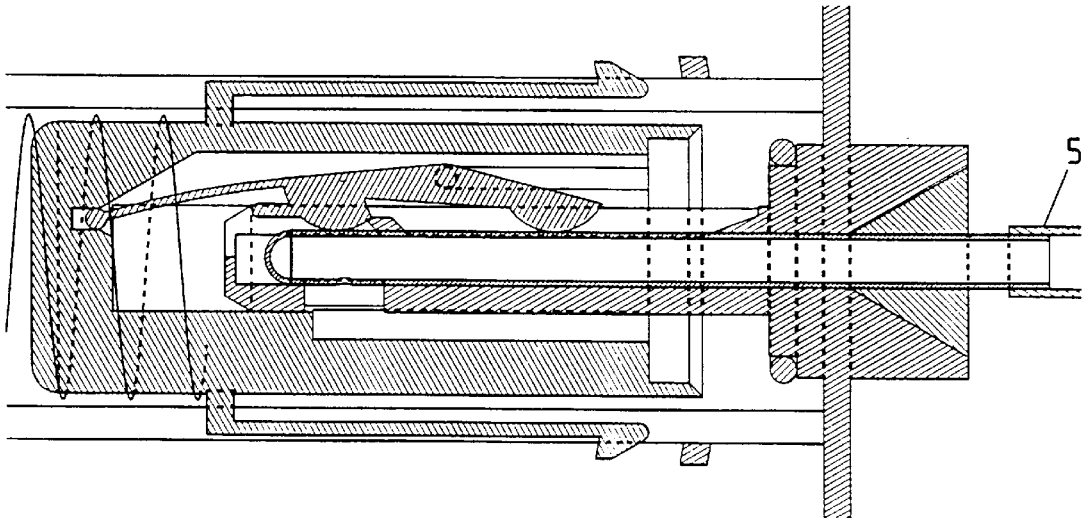
FIG. 3*b* is a longitudinal-sectional view of the cover device with the hollow needle inserted and unlocked.

If the hollow needle 4 is forced through the rubber-elastic closure 3 in the funnel 113 into the brace 112, then ink can flow out of the brace 112 through the opening 41 into the hollow needle 4. As the hollow needle 4 is introduced into the brace 112, the needle meets the spherical portion of the protrusion 2211 of the lever arm 221. The protrusion 2211 is pressed upward by the hollow needle, past the stop 11211, and remains force-lockingly resting with the spherical portion 2211, 2221 of the two lever arms 221, 222 on the hollow needle, as is seen in FIG. 3*b*. A force-locking connection is one which connects two elements together by force external to the elements, as opposed to a form-locking connection which is provided by the shapes of the elements themselves.

Figure 3C:
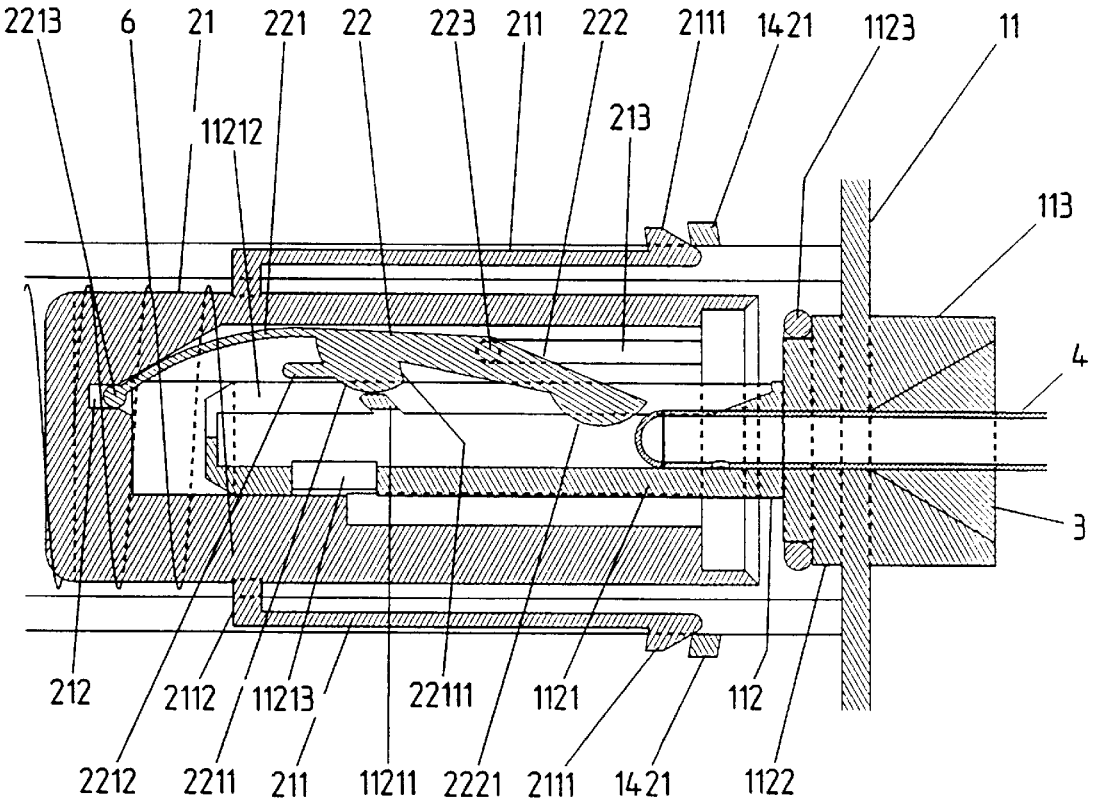
FIG. 3*c* is a longitudinal-sectional view of the cover device with the hollow needle pulled partway out.

If, as in FIG. 3*c*, the hollow needle 4 is pulled out of the brace 112, then the second lever arm 222 is no longer braced and pivots through the longitudinal slit 11212 into the brace 112, and as a result the protrusion 2211 of the first lever arm 221 slides past the stop 11211.

Figure 3D:
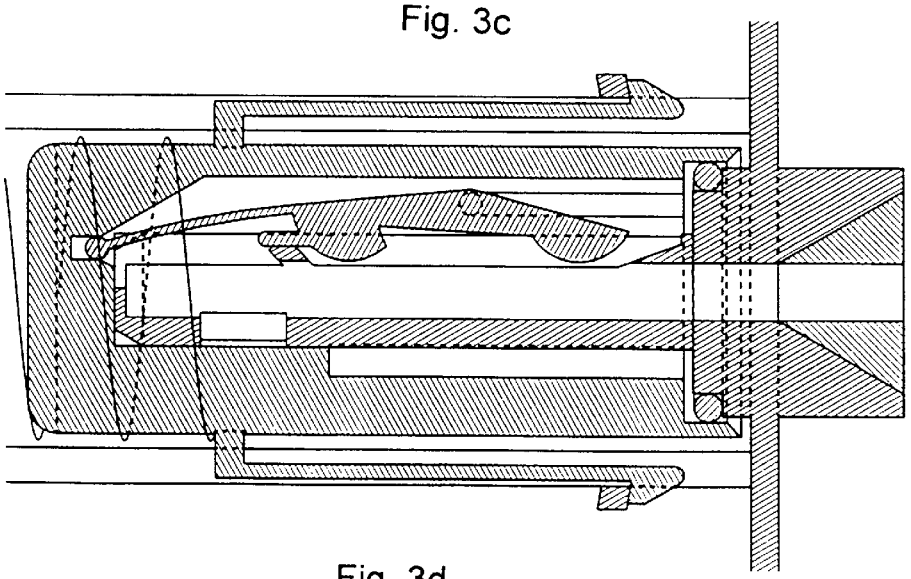
FIG. 3*d* is a longitudinal-sectional view of the cover device with the hollow needle pulled all the way out.

In FIG. 3*d*, the compression spring 6 thrusts the tube 21 with its opening onto the sealing ring 1123 and the neck 1122 of the brace 112, and thus it is closed irreversibly and hermetically by the detent locking of the tips 2111 of the detent hooks 211 behind the protrusions 1421 of the ribs 142. The cover device 2 has thus then assumed the second detent position.

The rocker 22 then rests on one hand with the prong-like extension 2212 of the first lever arm 221 on the stop 11211 and on the other hand is held with the roller-like end 2213 of the first lever arm 221 in the recess 212 in the bottom of the tube 21. In this position, both lever arms 221, 222 are located outside the interior of the brace 112. If the hollow needle 4 is reinserted, an operative connection with the rocker 22 is no longer possible. Since the ink printing head must operate against a vacuum, it is not even possible for the remaining ink from the brace to be used.

We claim:

1. An assembly for supplying ink to an ink printing head, comprising:

an ink printing head;

a hollow needle having an insertion region for receiving ink;

an ink connecting line communicating with said ink printing head and said needle for supplying ink from said needle to said printing head; and a container for holding ink, said container including:

a front wall with an inside surface having a brace formed thereon;

a rubber-elastic closure for receiving said insertion region of said needle; and a hermetically sealing cover device disposed inside said container for receiving said insertion region of said needle, said cover device including an axially displacable tube moveable to a locked position for preventing ink from being externally supplied and a resiliently supported rocker movable inside said tube, said rocker enabling said tube to be irreversibly moved to said locked position upon removal of said needle from said cover device.

2. The assembly according to claim 1, wherein:

said brace has a shaft and a neck;

said needle is guided in said shaft;

said tube is longitudinally displaced about said shaft, between two locked two positions and said tube has an opening;

said shaft has a stop thereon for said rocker; and said neck mates with said opening in said tube and has a rubber-elastic sealing ring.

3. The assembly according to claim 2, wherein:

said container has a rear wall and a bottom with ribs formed on the bottom and protrusions formed on the ribs;

said tube has a bottom, an outer jacket and resilient detent hooks attached to said outer jacket and resting displaceably on the ribs for locking on the protrusions;

said cover device has a compression spring fastened between said tube and the rear wall of the container;

said rocker has a shaft and first and second lever arms supported rotationally movably about said shaft;

said first lever arm points into said tube and acts as a securing lever having a roller-like end guided in an adapted recess formed in said tube bottom, said first lever arm has a formed-on, partly rounded protrusion, said protrusion has an edge to be locked on the stop of the shaft and said protrusion has a prong-like extension to be placed on the stop;

said second lever arm points at said opening of said tube and has a spherical end; and said shaft of said rocker is guided in a longitudinal groove formed in said tube and open toward said opening of said tube.

4. The assembly according to claim 2, wherein said tube has a fixed stroke length, said neck of said brace has an extension outside of the front wall of the housing, a funnel with a conical bore in said extension, and a rubber-elastic closure fitted into said conical bore, and said shaft of said brace has a longitudinal slit adapted to said rocker and to said fixed stroke length.

* * * * *